US007938674B2

(12) United States Patent
Lindkamp et al.

(10) Patent No.: US 7,938,674 B2
(45) Date of Patent: May 10, 2011

(54) CABLE CLAMP WITH CLAMPING ELEMENT

(75) Inventors: Marc Lindkamp, Luebbecke (DE); Andreas Kohler, Minden (DE)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 12/873,087

(22) Filed: Aug. 31, 2010

(65) Prior Publication Data

US 2011/0070766 A1 Mar. 24, 2011

(30) Foreign Application Priority Data

Sep. 23, 2009 (DE) ..... 10 2009 042 678

(51) Int. Cl.
*H01R 13/58* (2006.01)

(52) U.S. Cl. ..... 439/462; 439/461

(58) Field of Classification Search ..... 439/320, 439/454, 460, 461, 462, 583
See application file for complete search history.

(56) References Cited

U.S. PATENT DOCUMENTS

| | | | | |
|---|---|---|---|---|
| 4,358,079 | A * | 11/1982 | Navarro | 248/56 |
| 6,149,455 | A * | 11/2000 | Levi | 439/462 |
| 6,582,248 | B2 * | 6/2003 | Bachman | 439/462 |
| 6,752,650 | B1 * | 6/2004 | Lin | 439/491 |
| 7,086,897 | B2 * | 8/2006 | Montena | 439/578 |
| 7,850,472 | B2 * | 12/2010 | Friedrich et al. | 439/256 |

FOREIGN PATENT DOCUMENTS

| | | |
|---|---|---|
| EP | 0 908 995 | 9/1997 |
| EP | 0 921 604 | 10/1998 |

OTHER PUBLICATIONS

Official Action received in Applicants' underlying German Patent Application Serial No. 10 2009 042 678.7-34.

* cited by examiner

*Primary Examiner* — Tho D Ta
(74) *Attorney, Agent, or Firm* — Hayes Soloway P.C.

(57) ABSTRACT

In a cable clamp for fixing an electrical cable (8) that is connected to a connector, it is proposed to insert a clamping element (10) into a cylindrical cable receptacle (2) integrally moulded on the connector housing (1) such that it can be displaced by means of a pressure screw (20). Clamping fingers (13) that are integrally moulded on the clamping element (10) fix the electrical cable (8) extending within the clamping element (10) while guiding fingers (12) integrally moulded on the clamping element (10) prevent the clamping element (10) from turning.

4 Claims, 3 Drawing Sheets

CABLE CLAMP WITH CLAMPING ELEMENT

BACKGROUND OF THE INVENTION

1. Field of the Invention

The invention pertains to a device for fixing an electrical cable that is connected to a connector, wherein said device consists of a connector housing with a cylindrical cable receptacle integrally moulded thereon, and wherein a clamping element can be inserted into and displaced in the cable receptacle by means of a pressure screw.

A device of this type is required for clamping a cable that is connected to contact element of a connector and for fixing said cable on the connector housing. This serves for absorbing tensile loads on the cable of the connector and for the strain relief of the contact terminals of the connector, on which the cable is contacted.

2. Description of the Related Art

A few solutions for fixing cables on connectors are already known from the state of the art.

EP 0 908 995 A1 describes a screw-type cable fitting that features a lower part, a cap nut and a seal insert, wherein the seal insert is arranged in the cap nut and its cross section is reduced as the axial clamping force exerted upon the seal insert between the lower part and the cap nut increases.

One frequently utilized variation for the strain relief of electrical cables is the so-called crown spring.

In this case, a crown spring encompassing the cable is compressed when it is pressed into a conical sleeve on the connector end by means of a pressure screw and thusly holds the cable in the connector.

It is disadvantageous that turning of the crown spring or the seal insert is unavoidable when the strain relief device is screwed down. This may cause the clamped cable to turn as well such that the individual conductors in the cable may become damaged. In addition, such a device is respectively suitable for certain cable diameters only. This means that different crown springs or seal inserts need to be available for different diameters.

SUMMARY OF THE INVENTION

The invention therefore is based on the objective of disclosing a device for clamping a cable on a connector that prevents the cable from turning during the clamping process and is suitable for cables with different diameters.

This objective is attained in that the clamping element features several fingers that are combined into a ring structure on one end, in that the fingers have two different shapes, wherein a first shape is realized in the form of a guiding finger and a second shape is realized in the form of a clamping finger, and wherein the guiding fingers and the clamping fingers are arranged alternately and thusly form the ring structure of the clamping element, in that the clamping fingers feature a wedge-shaped end and the guiding fingers feature a smooth end, in that wedges are integrally moulded into the cable receptacle at an axial distance from the insertion end such that they progressively extend inward and are spaced apart from one another, in that a thread is formed within the cable receptacle and features a longitudinal recess in the regions, on which the wedges are integrally moulded, and in that the wedge-shaped ends of the clamping fingers of the clamping element come in contact with the wedges of the cable receptacle and progressively reduce the inside diameter when the clamping element is screwed into the cable receptacle by means of the pressure screw such that a cable extending within the clamping element is fixed.

The invention concerns a device that is required for clamping a cable connected to a connector on a connector in order to thusly absorb high tensile loads acting upon the cable and to achieve a strain relief of the terminals in the connector.

The advantages attained with the invention can be seen, in particular, in that turning of the cable as it occurs with similar devices is prevented during the installation on the connector. In addition, cables with a broader spectrum of different diameters can be clamped in position with the same device and it is no longer necessary to use parts that are adapted to each diameter.

A connector housing is provided with a cylindrical cable receptacle in order to accommodate an electrical cable. In order to fix the cable accommodated in the cable receptacle, a clamping element is inserted into and can be axially displaced in the cable receptacle by means of a pressure screw.

The clamping element is essentially realized in the form of an annular part with several axially aligned fingers that are connected on one end and thusly form the ring structure of the clamping element. The fingers have two different shapes. A first shape is realized in the form of a guiding finger and a second shape is realized in the form of a clamping finger. The guiding fingers and clamping fingers are arranged alternately in the ring structure.

The clamping fingers are provided with a thickening in the radial direction. The thickening flattens in the front section to be inserted first into the cable receptacle such that a wedge-shaped end is formed on the clamping fingers.

In the rear region, the clamping fingers are attached to the ring structure by means of a thin flexible web.

The guiding fingers of the clamping element are realized smooth on their outer surface and rigidly attached to the ring structure.

The cable receptacle essentially is integrally moulded on the connector housing in the form of a cylindrical structure. Wedges are integrally moulded into the cable receptacle at an axial distance from the insertion end and progressively extend inward. In addition, a thread suitable for receiving the pressure screw is formed in the cable receptacle from the insertion end up to the wedges.

The thread is provided with longitudinal recesses in the regions, on which the wedges are integrally moulded. The thickened clamping fingers of the clamping element slide in the longitudinal recesses when the clamping element is connected to the cable receptacle.

The pressure screw essentially consists of a body with the shape of a hollow cylinder. It features a cylindrical thread that is realized complementary to the thread of the cable receptacle in the front region that faces the connector. In the rear region that faces away from the connector, the pressure screw features a gripping region that is preferably provided with elevations or recesses in order to simplify the actuation of the pressure screw. The cable to be connected needs to be routed through the hollow inner region of the pressure screw.

In one advantageous additional development, the hollow inner region of the pressure screw is provided with a seal in order to prevent the admission of water and dirt.

When the clamping element is screwed into the cable receptacle by means of the pressure screw, the clamping fingers of the clamping element are axially guided in the longitudinal recesses of the thread such that the clamping element is already prevented from initially turning. In the region of the wedges, the guiding fingers are guided between the wedges such that the clamping element is effectively prevented from turning. Once the clamping fingers come in contact with the integral wedges, the wedge-shaped ends of the clamping fingers cooperate with the wedges in such a way that the diameter between the clamping fingers is progressively reduced. An electrical cable extending within the clamping element is thusly fixed between the clamping fingers without being turned by the clamping element.

In one preferred embodiment, the clamping element features locating means on the side that faces the pressure screw. The locating means are preferably arranged on the rear side of the guiding arms and can engage into a circumferential locating groove arranged in the front side of the pressure screw. The clamping element therefore is integrally connected to the pressure screw for the assembly, but still can be axially turned.

BRIEF DESCRIPTION OF THE DRAWINGS

One embodiment of the invention is illustrated in the figures and described in greater detail below the figures show.

DESCRIPTION OF THE PREFERRED EMBODIMENTS

Figure 1:
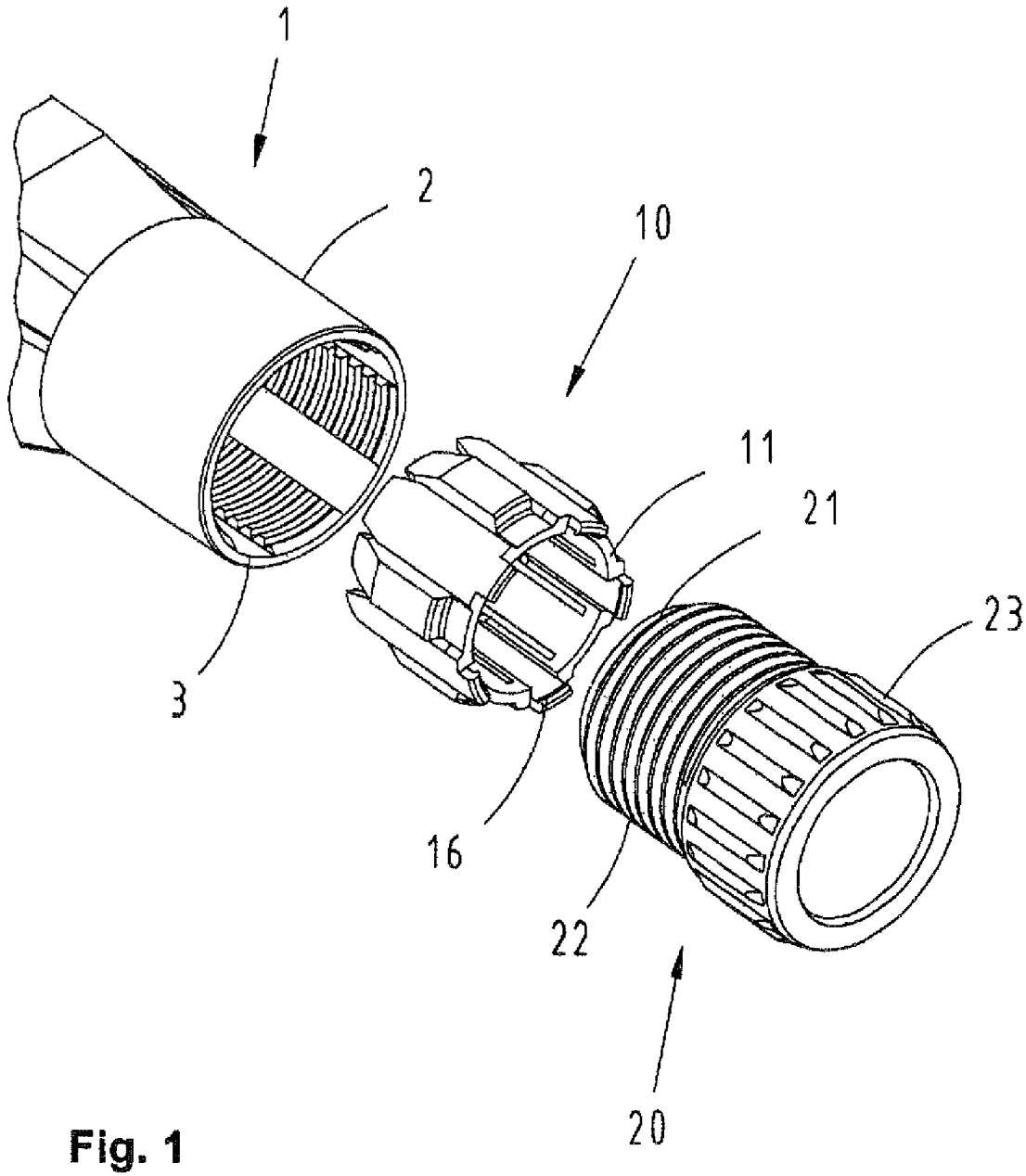
FIG. 1 a connector housing with a cable clamp in the form of an exploded view, FIG. 2 a clamping element in the form of a perspective representation viewed from the mating direction, FIG. 3 a view of the insertion end of the connector housing, FIG. 4 a sectional representation of the insertion end of the connector housing with the cable clamp, and FIG. 5 a cross section through a screwed-down cable clamp with an electrical cable.

FIG. 1 shows a perspective representation of a connector housing 1 with a cable clamp. A mating region for accommodating contact elements is provided in the section of the connector housing 1 shown on the left, but not illustrated in detail. A cable receptacle 2 with a clamping element 10 positioned in front of its insertion end 3 and a pressure screw 20 is situated adjacent to said mating region.

The pressure screw 20 with the shape of a hollow cylinder essentially features a cylindrical thread 22 and a gripping region 23. A locating groove 21 provided for engaging the clamping element 10 therein is situated in front of the thread 22.

An electrical cable 8 to be connected is routed into the connector housing 1 through the pressure screw 20 and the clamping element 10.

Figure 2:
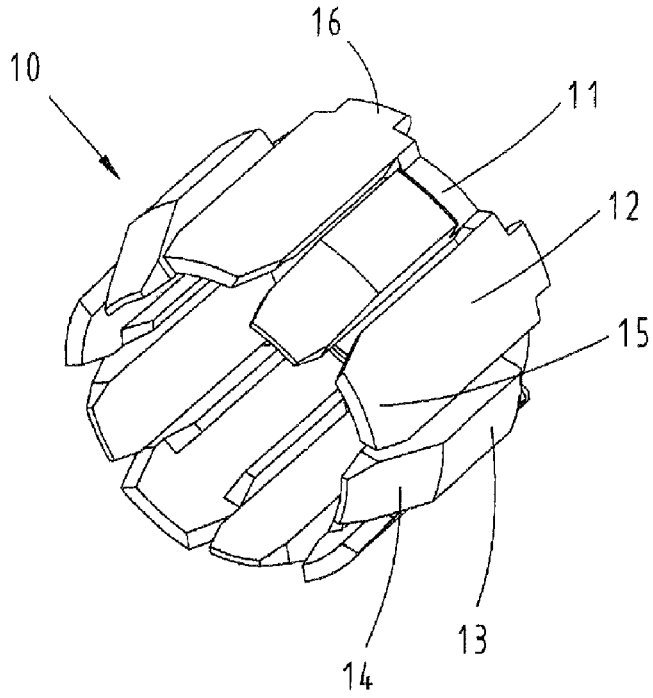

The clamping element 10 illustrated in FIG. 2 consists of five guiding fingers 12 and five clamping fingers 13 that are arranged axially and combined into a ring structure 11 on their end that faces away from the connector housing 1. This figure shows that the clamping fingers 13 are radially thicker than the guiding fingers 12 and feature a wedge-shaped end 14. When the clamping element 10 is connected to the cable receptacle 2, the thickened clamping fingers 13 are guided in longitudinal recesses 6 in the cable receptacle 2 such that the clamping element 10 is prevented from turning.

The ring structure 11 furthermore features locating means 16 that serve for engaging the clamping element 10 on the pressure screw 20. A locating groove 21 provided for this purpose in the pressure screw 20 ensures that the clamping element 10 and the pressure screw 20 can be turned relative to one another.

Figure 3:
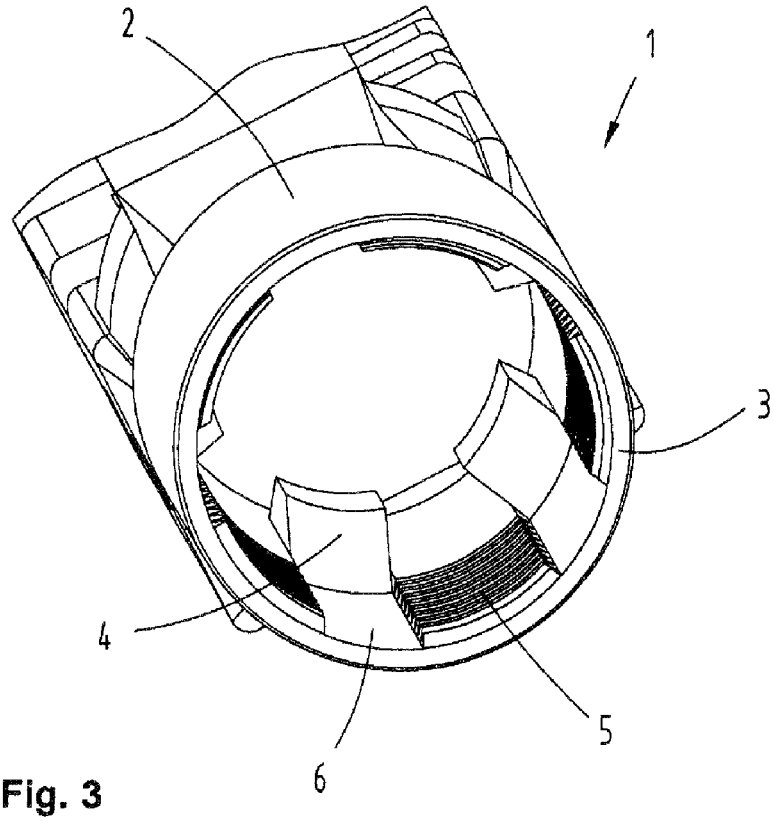

FIG. 3 shows the cable receptacle 2 from the direction of its insertion end 3. In this case, five wedges 4 are integrally moulded on the cable receptacle at an axial distance from the insertion end 3 and progressively extend radially inward.

The number of wedges 4 and their distance from one another are chosen in accordance with the number of clamping fingers 13 of the clamping element 10 and their distance from one another.

A thread 5, into which the pressure screw 20 can be screwed, is formed within the cable receptacle 2 from the insertion end 3 up to the wedges 4. Longitudinal recesses 6 are provided in the thread 5 in the region of the wedges 4 and extend from the insertion end 3 up to the wedges 4.

Figure 4:
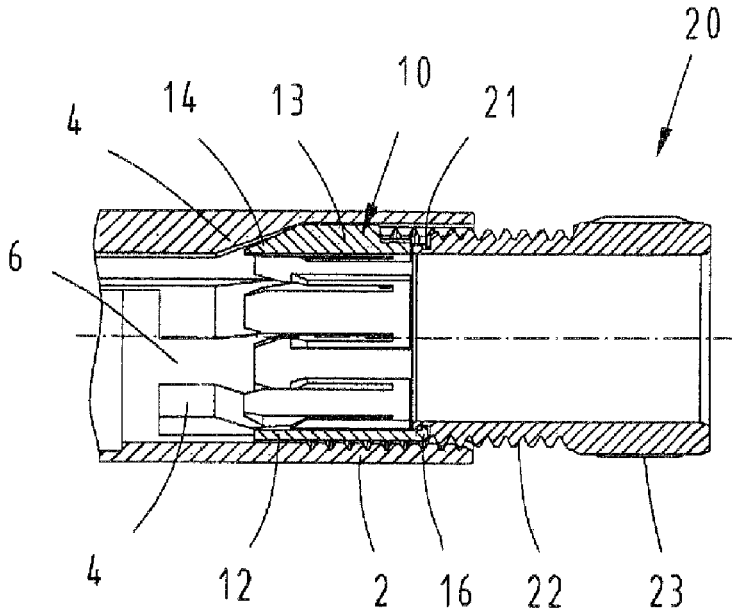

FIG. 4 shows a cross section through a cable clamp, however, without electrical cable.

The pressure screw 20 is only screwed so far into the cable receptacle 2 that the wedge-shaped ends 14 of the clamping fingers 13 come in contact with the wedges 4 in the cable receptacle 2. The central region of the sectional representation furthermore shows how the guiding fingers 12 are guided between the wedges 4.

Figure 5:
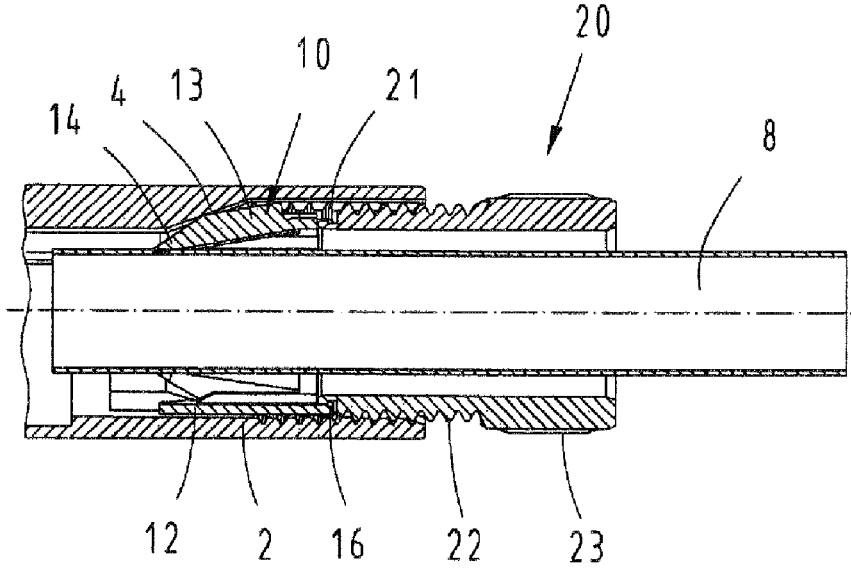

FIG. 5 shows a cable clamp with an electrical cable 8 and a partially screwed-down pressure screw 20.

The axial-radial displacement of the clamping element 10 in the cable receptacle 2 produced by means of the pressure screw 20 causes the wedge-shaped ends 14 of the clamping fingers 13 to cooperate with the wedges 4. The resulting reduction of the diameter between the clamping fingers 13 then fixes the electrical cable 8 extending through the clamping element 10.

What is claimed is:

1. A device for fixing an electrical cable that is connected to a connector, comprising a connector housing with a cylindrical cable receptacle integrally moulded thereon, wherein a clamping element can be inserted into and displaced in the cable receptacle using a pressure screw, wherein the clamping element features several fingers that are combined into a ring structure on one end, wherein the fingers have two difference shapes, wherein a first shape is realized in the form of a guiding finger and a second shape is realized in the form of a clamping finger, wherein the guiding fingers and the clamping fingers are arranged alternatively and thusly form the ring structure of the clamping element, wherein the clamping fingers feature a wedge-shaped end and the guiding fingers feature a smooth end, wherein that wedges are integrally moulded into the cable receptacle at an axial distance from the insertion and end such that they progressively extend inward and are spaced apart from one another, wherein a thread is formed within the cable receptacle and features a longitudinal recess in the regions, on which the wedges are integrally moulded, and wherein the wedge-shaped ends of the clamping fingers of the clamping element come in contact with the wedges of the cable receptacle and progressively reduce the inside diameter of said ring structure when the clamping element is screwed into the cable receptacle using the pressure screw such that a cable extending within the clamping element is fixed.

2. The device according to claim 1, wherein the clamping fingers are guided in the longitudinal recesses in the thread of the cable receptacle during the assembly.

3. The device according to claim 1, wherein the guiding fingers are guided between the wedges in the region of the thread in the cable receptacle when the clamping element is screwed down using the pressure screw such that the clamping element is prevented from turning.

4. The device according to claim 1, wherein that the clamping element is held on the pressure screw with the aid of a locating device.

* * * * *